US006982690B2

(12) United States Patent
Lee et al.

(10) Patent No.: US 6,982,690 B2
(45) Date of Patent: Jan. 3, 2006

(54) DISPLAY APPARATUS WITH A DRIVING CIRCUIT IN WHICH EVERY THREE ADJACENT PIXELS ARE COUPLED TO THE SAME DATA LINE

(75) Inventors: Hsin-Ta Lee, Taoyuan (TW); Chao-Wen Wu, Ilan (TW); Yuan-Liang Wu, Tainan (TW); Tien-Jen Lin, Tainan (TW); Chin-Lung Ting, Tainan (TW)

(73) Assignee: Chi Mei Optoelectronics Corp., Tainan (TW)

( * ) Notice: Subject to any disclaimer, the term of this patent is extended or adjusted under 35 U.S.C. 154(b) by 335 days.

(21) Appl. No.: 10/401,443

(22) Filed: Mar. 27, 2003

(65) Prior Publication Data

US 2003/0189559 A1 Oct. 9, 2003

(30) Foreign Application Priority Data

Mar. 29, 2002 (TW) ..... 091106436

(51) Int. Cl.
*G09G 3/36* (2006.01)

(52) U.S. Cl. ..... 345/87; 345/92

(58) Field of Classification Search ..... 345/84, 345/87, 88, 89, 90, 92, 93, 98, 100, 103, 345/204
See application file for complete search history.

(56) References Cited

U.S. PATENT DOCUMENTS

| | | | | |
|---|---|---|---|---|
| 5,132,820 | A * | 7/1992 | Someya et al. | 349/106 |
| 5,253,091 | A * | 10/1993 | Kimura et al. | 345/94 |
| 6,011,530 | A * | 1/2000 | Kawahata et al. | 345/90 |
| 6,300,977 | B1 * | 10/2001 | Waechter et al. | 348/300 |
| 6,583,777 | B2 * | 6/2003 | Hebiguchi et al. | 345/92 |
| 2002/0054003 | A1 * | 5/2002 | Kodate | 345/87 |

* cited by examiner

*Primary Examiner*—Regina Liang
(74) *Attorney, Agent, or Firm*—Thomas, Kayden, Horstemeyer & Risley

(57) ABSTRACT

A display apparatus includes a first scan line; a first data line perpendicular to the first scan line; a first pixel, a second pixel, and a third pixel which are adjacent and coupled to the same data line respectively; and a first switching device, a second switching device, and a third switching device set in the first, second, and third pixels respectively. The data signals can be selectively input into the corresponding pixels from the first data line by enabling/disabling the corresponding scan lines.

13 Claims, 10 Drawing Sheets

DISPLAY APPARATUS WITH A DRIVING CIRCUIT IN WHICH EVERY THREE ADJACENT PIXELS ARE COUPLED TO THE SAME DATA LINE

BACKGROUND OF THE INVENTION

This application claims the benefit of Taiwan application Serial No. 091106436, filed Mar. 29, 2002.

1. Field of the Invention

The invention relates in general to a display apparatus, and more particularly to a display apparatus with a driving circuit in which every three adjacent pixels are coupled to the same data line.

2. Description of the Related Art

Liquid Crystal Displays (LCDs) have been widely used throughout the world because they feature the favorable properties of thinness and lightness and generate low levels of radiation.

FIG. 1 shows a circuit diagram illustrating a conventional LCD panel. The display panel includes a plurality of pixels (P). The pixels are arranged in the form of a matrix on the display panel. The display panel includes an active matrix driving circuit for driving the pixels. The active matrix driving circuit includes a plurality of scan lines (S), a plurality of data lines (D), and a plurality of switching devices. The switching devices are set in the pixels for selectively transmitting the corresponding data signals to the pixels. The switching device can be a thin film transistor (TFT), such as an n-type field effect transistor (n-FET) or a p-type field effect transistor (p-FET). In FIG. 1, the switching device of each pixel includes a thin film transistor. The thin film transistor in each pixel includes a gate electrode, a first source/drain electrode, and a second source/drain electrode. The gate electrode of the thin film transistor is coupled to the corresponding scan line, and the first source/drain electrode is coupled to the corresponding data line. Using the pixel P(m,n) as an example the pixel P(m,n) includes a thin film transistor M1. The gate electrode of the thin film transistor M1 is coupled to the scan line $S_m$, and the first source/drain electrode of the thin film transistor M1 is coupled to the data line $D_n$. Each scan line is perpendicular to each data line. Each pixel in the same pixel row is coupled to the same scan line, and each pixel in the same pixel column is coupled to the same data line, as shown in FIG. 1.

FIG. 2 shows the configuration of a conventional active matrix liquid crystal display. The conventional active matrix liquid crystal display includes a display panel 202, an X board 212, and a Y board 214. The display panel 202 includes the pixels and the active matrix driving circuit, as shown in FIG. 1. The Y board 214 is coupled to a plurality of scan drivers 206 set in the tape carrier packages 210. Each scan driver 206 is coupled to the Y board 214 and the corresponding scan lines respectively. The X board 212 is coupled to a plurality of data drivers 204 set in the tape carrier packages (TCP) 208. Each data driver 204 is coupled to the X board 212 and the corresponding data lines respectively. The Y board 214 and the scan drivers 206 are used for enabling the corresponding scan lines through inputting a scan signal into the scan line. When the scan line is enabled, each pixel in the pixel row coupled to the scan line can be turned ON. The X board 212 and the data drivers 204 are used for inputting the data signals to the corresponding pixels through the corresponding data lines when the pixels are turned ON.

The conventional active matrix liquid crystal display has the following disadvantages. First, a large number of data lines are needed. For example, an active matrix display panel has a resolution of 1024×768; that is, the active matrix display panel has 1024 pixel columns and each pixel column has 1024×3=3072 pixels. Therefore, the active matrix display panel must include 3072 data lines. This is a large number of data lines. First, since so many data lines are needed, the pitch between the adjacent data lines must be small. Second, each data line is coupled to the corresponding data driver through the outer lead of the tape carrier package, and it is both difficult and elaborate to connect all data lines to the corresponding outer leads of the tape carrier packages. Third, the aperture ratio of the display panel will be decreased since the number of data lines is so large.

FIG. 3 shows a diagram of a conventional time domain multiplex driving circuit. In the conventional time domain multiplex driving circuit, every two adjacent pixels in the same pixel row are coupled to the same data line. These two pixels are set on the left and right sides of the data line respectively. The pixel set on the left side of the data line is called the left pixel (LP), and the pixel set on the right side of the data line is called the right pixel (RP). The switching devices for the pixels LP and RP are different. Take the pixels LP(m,n) and RP(m,n) as an example. These two pixels are both coupled to the same scan line $S_m$ and the same data line $D_n$. The pixel LP(m,n) is set on the left side of the data line $D_n$, and the pixel RP(m,n) is set on the right side of the data line $D_n$, as shown in FIG. 3. The pixel RP(m,n) switching device includes a thin film transistor M2. The gate electrode of the thin film transistor M2 is coupled to the scan line $S_m$, and the first source/drain electrode of the thin film transistor M2 is coupled to the data line $D_n$. The switching device of the pixel LP(m,n) is different from that of the pixel RP(m,n). The switching device of the pixel LP(m,n) includes two thin film transistors M11 and M12. The gate electrode of the thin film transistor M11 is coupled to the scan line $S_{m+1}$, and the first source/drain electrode of the thin film transistor M11 is coupled to the data line $D_n$. The gate electrode of the thin film transistor M12 is coupled to the scan line $S_m$, and the first source/drain electrode of the thin film transistor M12 is coupled to the second source/drain electrode of the thin film transistor M11, as shown in FIG. 3.

FIG. 4 shows a timing chart for the scan signals of scan lines $S_m$, $S_{m+1}$, and $S_{m+2}$ and the ON and OFF status of the corresponding pixels LP(m,n), RP(m,n), LP(m+1,n), and RP(m+1,n) shown in FIG. 3. The method for driving a display panel with the above-described time domain multiplex driving circuit is called a time domain multiplex driving method. When the time domain multiplex driving method is executed, each pixel row is driven in turn by the time domain multiplex driving circuit. The time domain multiplex driving method includes two scanning procedures. The first scanning procedure is to selectively turn on the left pixels of the pixel row by turning on two corresponding TFTs of each of the left pixels and then feeding the corresponding data signals into the respective left pixels. The second scanning procedure is to selectively turn on the right pixels of the pixel row by turning on one corresponding TFT of each right pixel and then feeding the corresponding data signals into the respective right pixels.

Using pixels LP(m,n) and RP(m,n) shown in FIG. 3 as an example, during time period T1, the scan lines $S_m$ and $S_{m+1}$ are enabled. The thin film transistors M11 and M12 can be turned ON, and a data signal can be input to the corresponding pixel LP(m,n) through the TFTs M11 and M12. In the time period T2, only the scan line $S_m$ is enabled. The thin film transistor M2 can be turned ON, and a data signal can be input to the corresponding pixel RP(m,n) through the TFT M2.

In the time domain multiplex driving circuit, the above-described disadvantages of the conventional active matrix driving circuit can be improved. If the resolution of the display panel is 1024×768, for example, every two adjacent pixels in the same pixel row are coupled to one corresponding data line of the time domain multiplex driving circuit, and thus only 3072/2=1536 data lines are needed.

However, the conventional time domain multiplex driving circuit disclosed above has the following disadvantage. An equivalent capacitor between the gate electrode and the second source/drain electrode is created when the thin film transistor is turned ON. The output voltage will be lower than the input voltage of the thin film transistor, and the luminance of the pixel may be decreased because of the equivalent capacitor. This effect caused by the equivalent capacitor is called the feed-through effect. The larger the capacitance of the equivalent capacitor is, the larger the difference between the output voltage and the input voltage of the thin film transistor is. Take the pixels LP(m,n) and RP(m,n) shown in FIG. 3 as an example. The switching device of the pixel RP(m,n) includes only one thin film transistor M2 and the switching device of the pixel LP(m,n) includes two thin film transistors M1 and M12. The data signal inputted to the pixel RP(m,n) only through the thin film transistors M2 but the data signal inputted to the pixel LP(m,n) through two thin film transistors, M11 and M12. Therefore, the equivalent capacitor of LP(m,n) is much larger than that of RP(m,n). During driving of the pixels by the time domain multiplex driving circuit, the luminance of the pixel LP(m,n) will be less than that of the pixel RP(m,n) when the data signals of the same magnitude are input to the pixels LP(m,n) and RP(m,n) respectively. Therefore, the luminance of the adjacent pixels may not be the same even when the data signals of the same magnitude are input to the respective pixels. Since pixel LP(m,n) includes two thin film transistors and the pixel RP(m,n) includes only one thin film transistor, the aperture ratio of these two adjacent pixels may not be the same. The luminance of the pixel can be affected by the aperture ratio of the pixel, and because of the feed-through effect and the aperture ratio of the pixel, the display performance of the liquid crystal display would thus be degraded.

FIGS. 5A~5C illustrate the conventional driving circuit shown in FIG. 3 of the pixels, the pixel columns, and the pixel units respectively. FIG. 5A shows the conventional driving circuit of the pixels, as shown in FIG. 3. In reference to FIG. 5B, the method used for inputting data signals into the corresponding pixels of the color display panel is, taking the adjacent pixels LP(m,n), RP(m,n), and LP(m,n+1) as an example, to input the data signal for showing red into the pixel LP(m,n), the data signal for showing green into the pixel RP(m,n), and the data signal for showing blue into the pixel LP(m,n+1) respectively. All other pixels in the same column as the pixel LP(m,n) are input with the data signals for showing red. The pixel column is thus called the red pixel column RPC1. In the same manner, all other pixels in the same column with the pixel RP(m,n) are input with the data signals to show green. The pixel column is thus called green pixel column GPC1. All other pixels in the same column with the pixel LP(m,n+1) are input with data signals to show blue; the pixel column is thus called blue pixel column BPC1. Following the same order, the pixel column that includes the pixel RP(m,n+1) is for displaying red, the pixel column that includes the pixel LP(m,n+2) is for displaying green, and the pixel column which includes the pixel RP(m,n+2) is for displaying blue respectively. Therefore, these three adjacent pixel columns are called red pixel column RPC2, green pixel column GPC2, and blue pixel column BPC2 respectively. In reference to FIG. 5C, taking the pixel unit PU1 as an example, pixel unit PU1 includes three adjacent pixels LP(m,n), RP(m,n), and LP(m,n+1). Since the pixel LP(m,n), RP(m,n), and LP(m,n+1) are for displaying red, green, and blue respectively, the displaying color of the pixel unit PU1 can be controlled by controlling the luminance of these three pixels. In the same manner, the displaying color of the pixel unit PU2 can be controlled by controlling the luminance of pixels RP(m,n+1), LP(m,n+2), and RP(m,n+2) respectively. Every three adjacent pixels are grouped into a pixel unit for displaying color, as shown in FIG. 5C.

Taking pixel LP(m,n) of pixel unit PU1 and pixel RP(m, n+1) of pixel unit PU2 as an example, in FIG. 5C, both pixels LP(m,n) and RP(m,n+1) are for displaying red. However, because the degree of the feed-through effect and the aperture ratio of these two pixels are different, the luminance of these two pixels can be different even when the magnitude of the data signals input to these two respective pixels are the same. In the same manner, the luminance of the pixel of pixel unit PU1, which is for displaying green, and the corresponding pixel of pixel unit PU2 and the pixel of pixel unit PU1, which is for displaying blue, and the corresponding pixel of pixel unit PU2 cannot be the same even when the respective input data signals are of the same magnitude.

Therefore, the color of the two adjacent pixel unit columns cannot be the same when inputting data signals of the same magnitude into these two adjacent pixel unit columns. This phenomenon is called odd-even line, and it may result in degradation of the liquid crystal display performance.

SUMMARY OF THE INVENTION

It is therefore an objective of the present invention to provide a display apparatus with a driving circuit for driving the pixels of the display apparatus so as to achieve the objectives, where the number of data lines can be further decreased and the odd-even line problem can be avoided.

According to the objectives of the present invention, it provides a display apparatus with a driving circuit in which every three adjacent pixels are coupled to the same data line. The display apparatus comprises a first scan line arranged in a first direction; a first data line arranged in a second direction, wherein the second direction is perpendicular to the first direction; a first pixel coupled to the first data line and the first scan line respectively; a second pixel coupled to the first data line and the first scan line respectively; a third pixel coupled to the first data line and the first scan line respectively; a first switching device in the first pixel for selectively transmitting a first data signal to the first pixel from the first data line; a second switching device in the second pixel for selectively transmitting a second data signal to the second pixel from the first data line; and a third switching device in the third pixel for selectively transmitting a third data signal to the third pixel from the first data line.

Other objects, features, and advantages of the invention will become apparent from the following detailed description of the preferred but non-limiting embodiments. The following description is made with reference to the accompanying drawings.

DETAILED DESCRIPTION OF PREFERRED EMBODIMENTS

Figure 1:
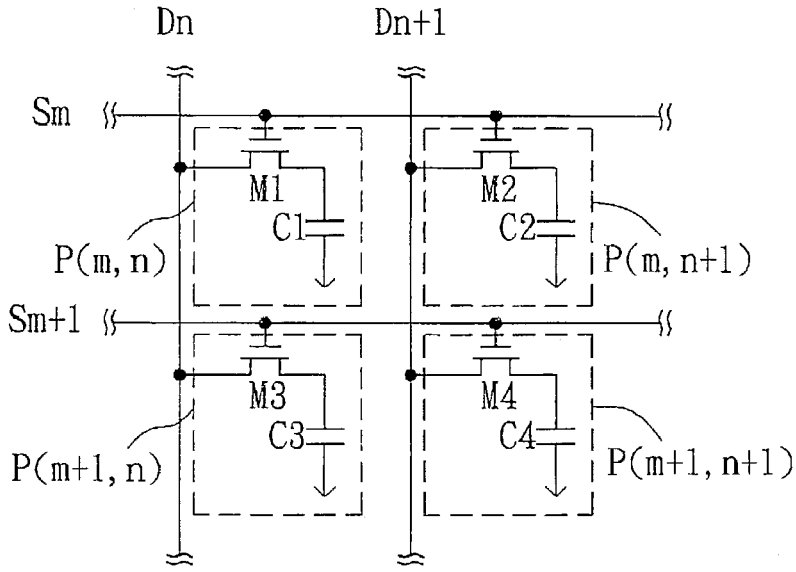
FIG. 1 (PRIOR ART)
FIG. 1 shows a circuit diagram illustrating a conventional liquid crystal display panel.
Figure 2:
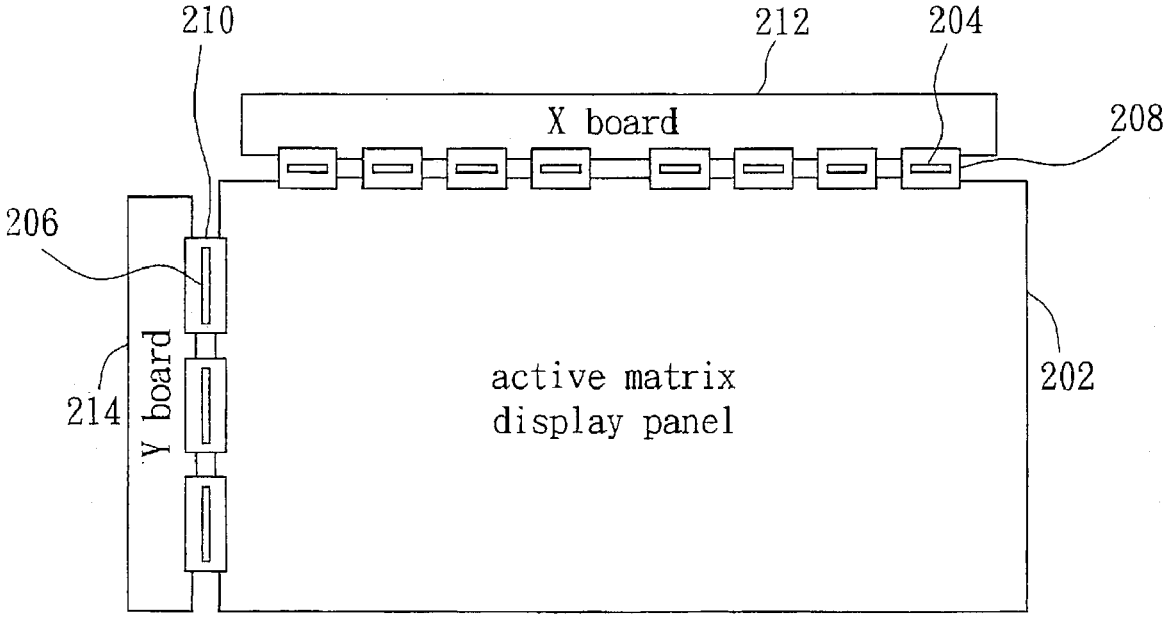
FIG. 2 (PRIOR ART)
FIG. 2 shows the configuration of a conventional active matrix liquid crystal display.
Figure 3:
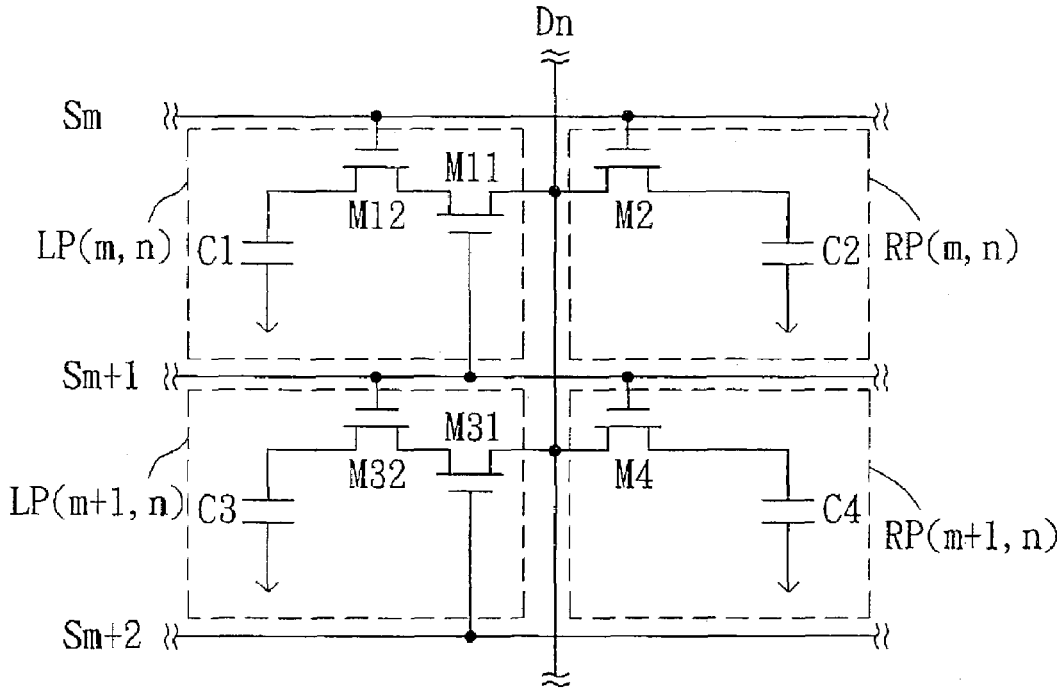
FIG. 3 (PRIOR ART)
FIG. 3 illustrates a conventional time domain multiplex driving circuit.
Figure 4:
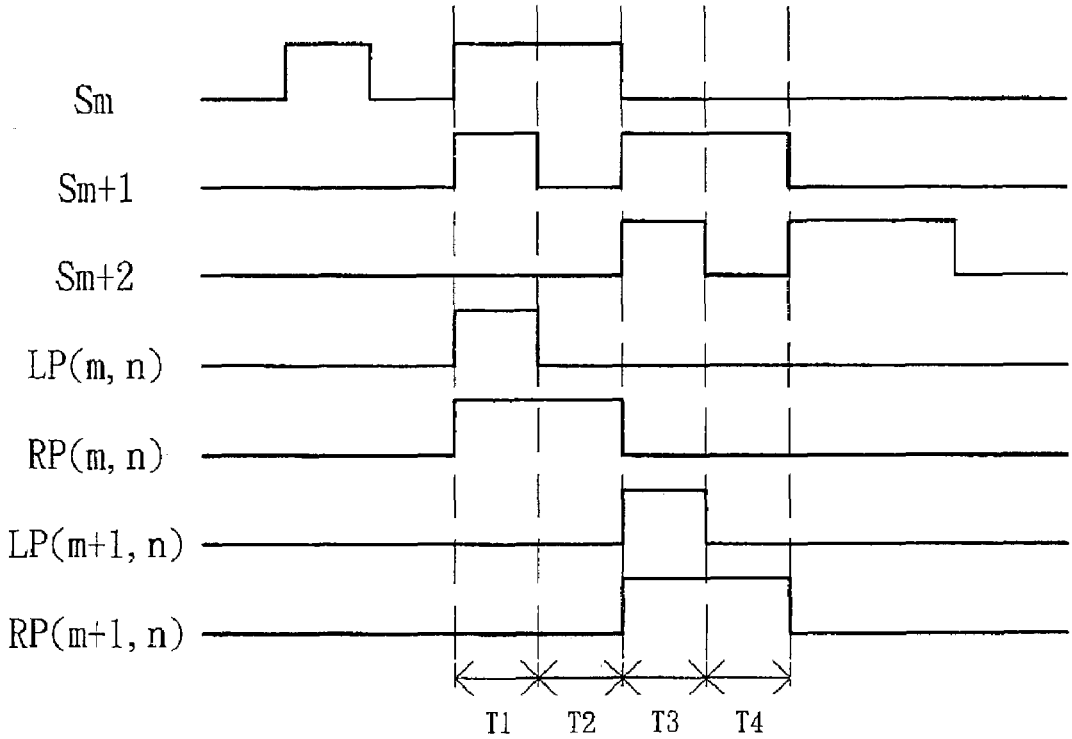
FIG. 4 (PRIOR ART)
FIG. 4 shows a timing chart of the scan signals from scan lines $S_m$, $S_{m+1}$, and $S_{m+2}$ and the ON and OFF status of corresponding pixels LP(m,n), RP(m,n), LP (m+1,n), and RP(m+1,n) shown in FIG. 3.
Figure 5A:
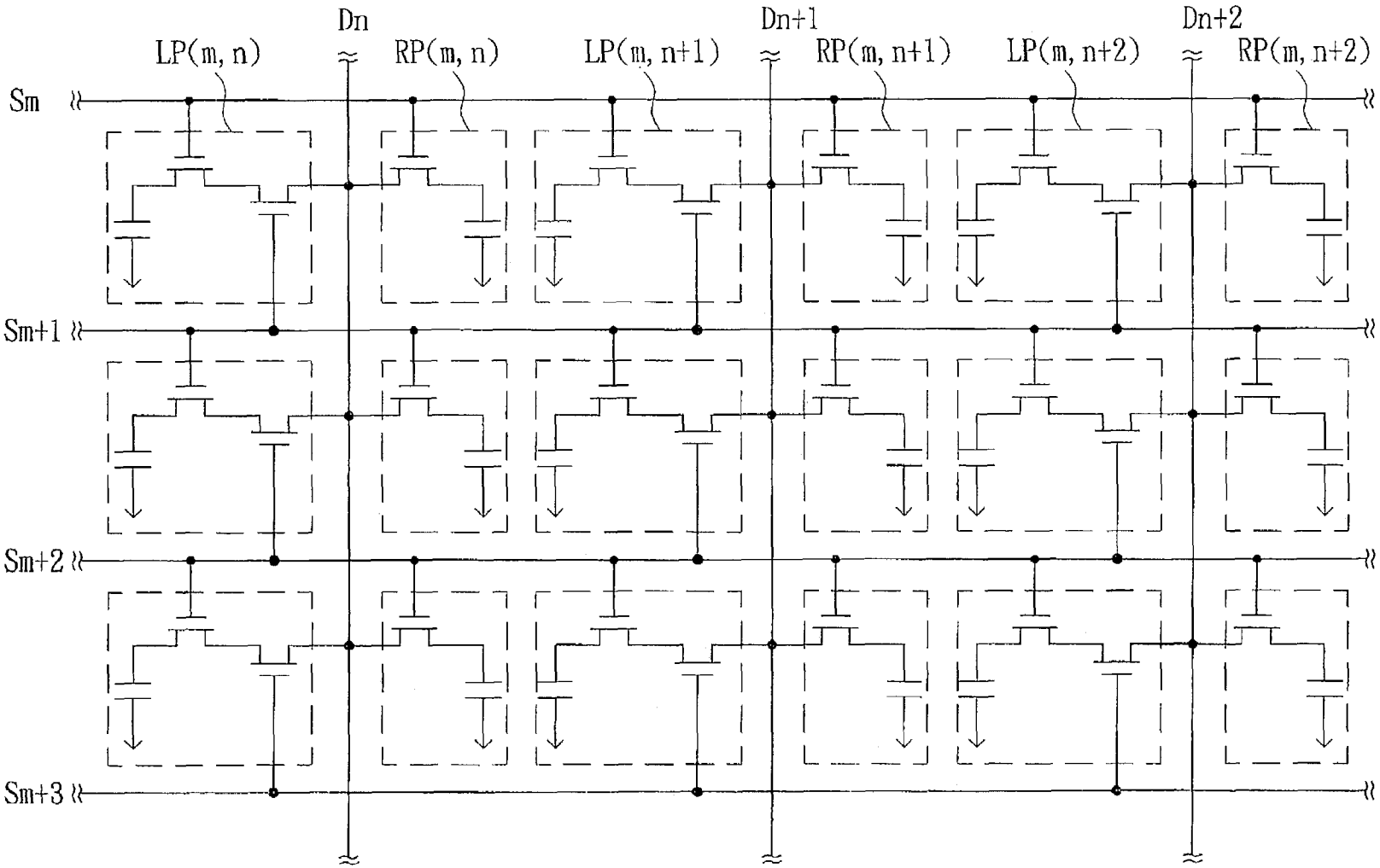
FIG. 5A (PRIOR ART)
FIGS. 5A~5C illustrate the conventional driving circuit shown in FIG. 3 of the pixels, the pixel columns, and the pixel units respectively.
Figure 5B:
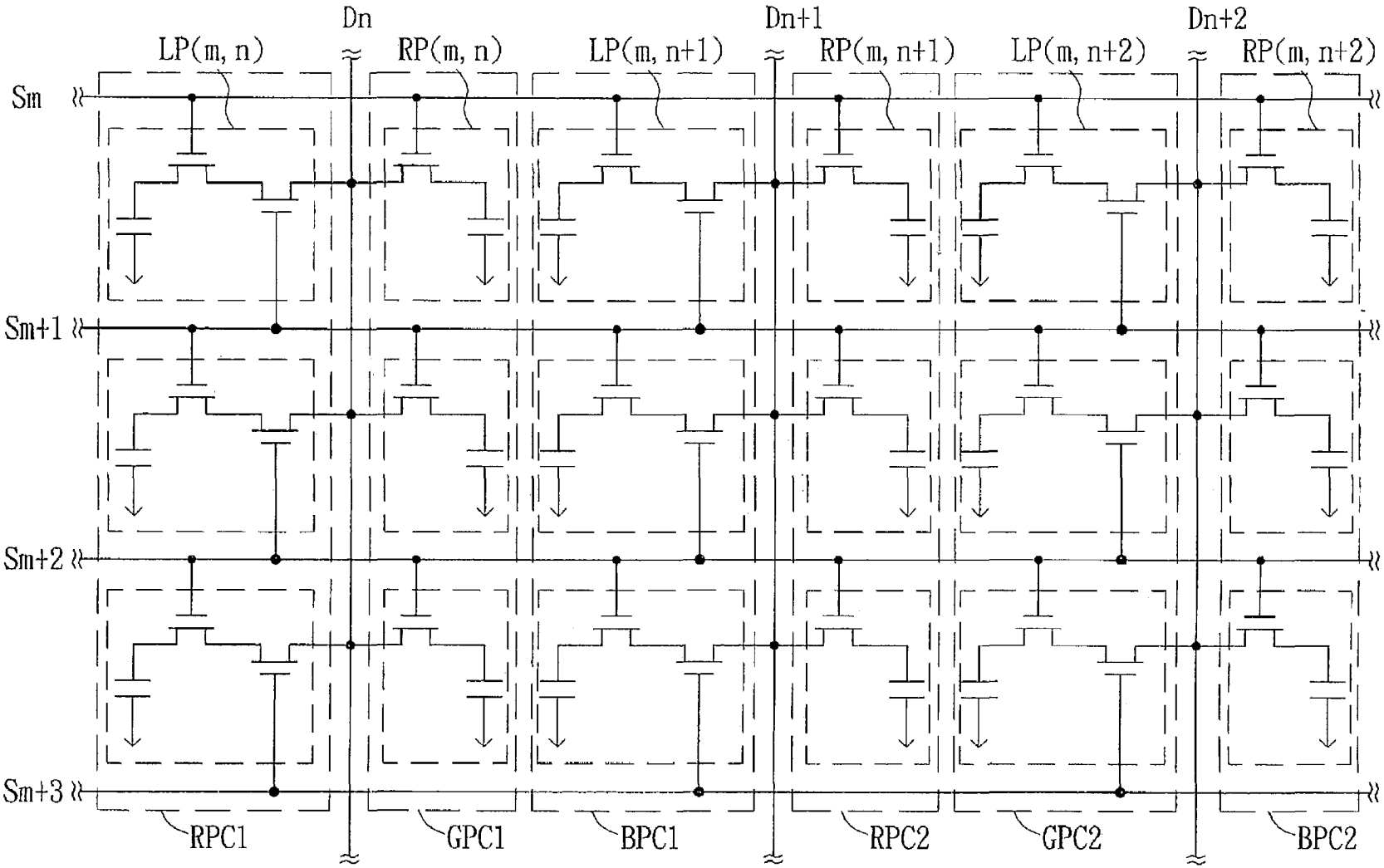
FIG. 5B (PRIOR ART)
Figure 5C:
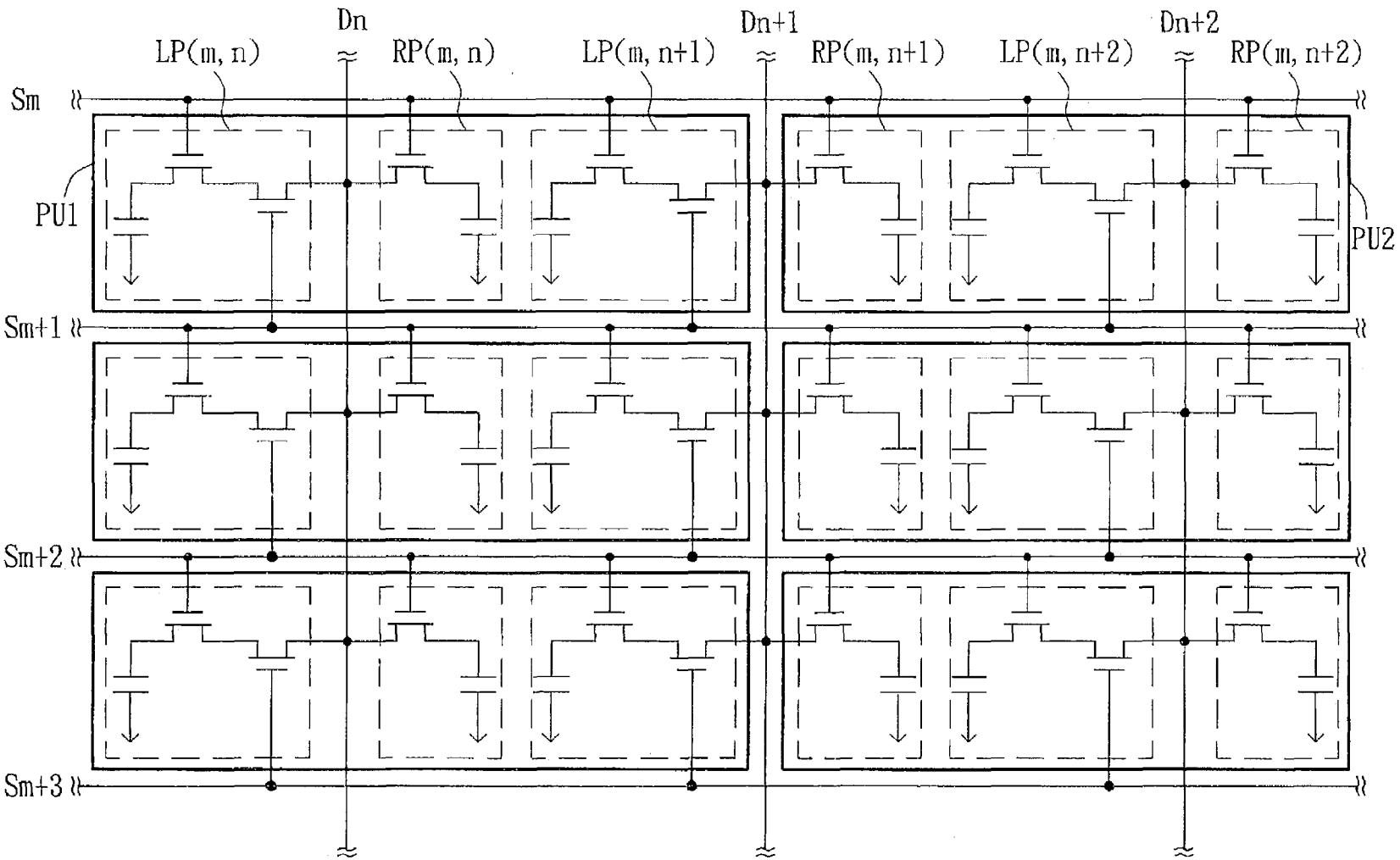
FIG. 5C (PRIOR ART)
Figure 6:
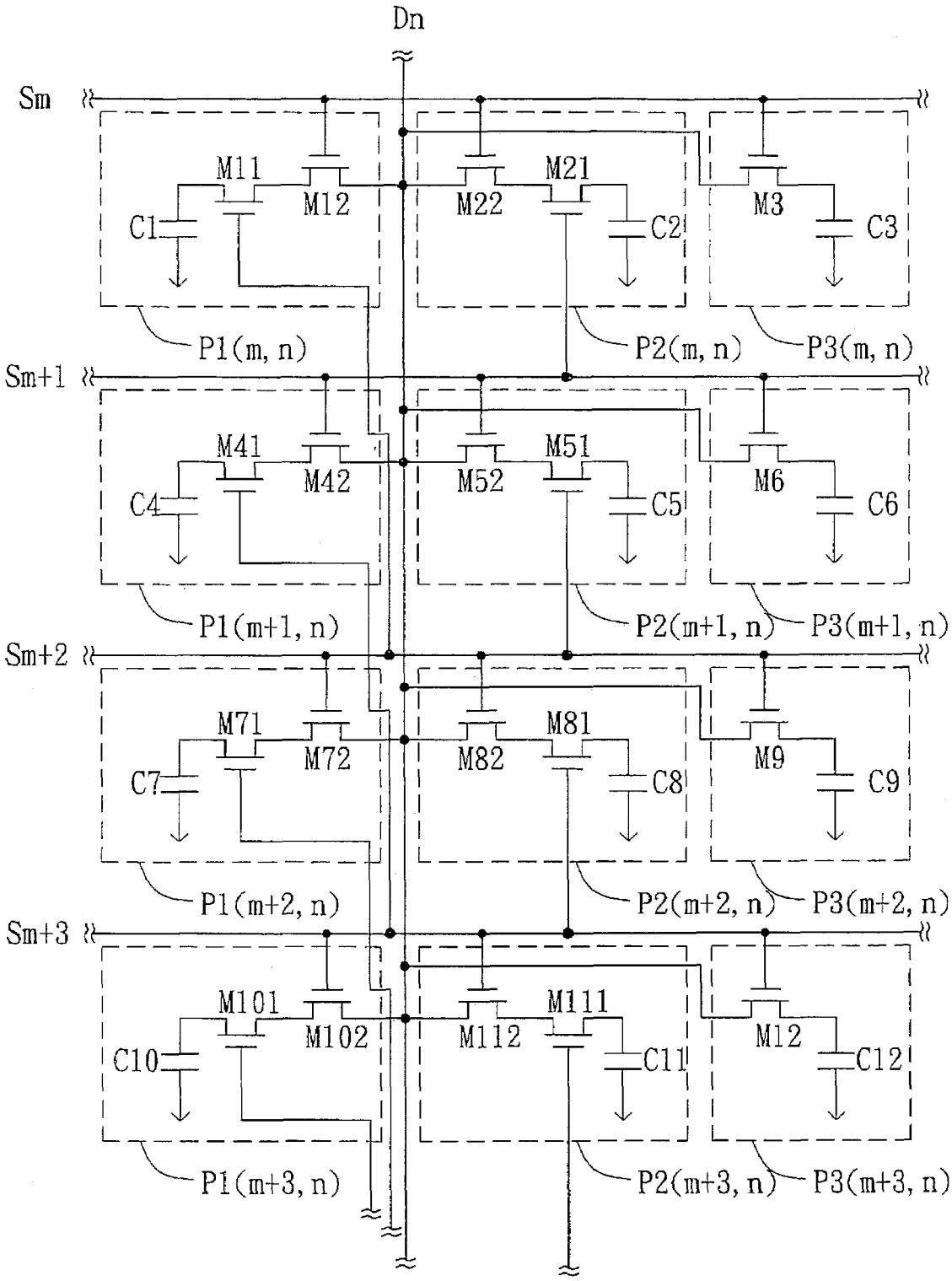
FIG. 6 shows a diagram of the driving circuit according to the preferred embodiment of the present invention.

FIG. 6 shows a diagram of the driving circuit according to the preferred embodiment of the present invention. Take the pixels in the $m^{th}$ row, the first pixel P1 (m,n), second pixel P2(m,n), and third pixel P3(m,n) shown in FIG. 6 for example; these three adjacent pixels are coupled to the same scan line $S_m$ and the same data line $D_n$. It should be noted that if the resolution of the display panel is 1024×768, for example, only 3072/3=1024 data lines are needed to drive all pixels in the display panel. The number of data lines can be further decreased compared to the conventional time domain multiplex driving circuit described above, and the number of data drivers for driving the data lines can be decreased as well. The complexity and cost of manufacturing the driving circuit can also be reduced, and, since the number of data lines is decreased, the pitch between the data lines can be wider. Thus, it will be easier to couple each outer lead of the tape carrier packages (TCP) with the corresponding data line. In addition, the aperture ratio of the display panel may be higher because the number of the data lines are decreased.

Please refer to FIG. 6. The first pixel P1(m,n) is controlled by the first switching device, which includes two switches M11 and M12. The first switching device is for selectively transmitting the data signal to the first pixel P1(m,n) from the data line $D_n$ by controlling the ON/OFF status of switches M11 and M12. The second pixel P2(m,n) is controlled by the second switching device, which includes two switches M21 and M22. The second switching device is for selectively transmitting the data signal to the second pixel P2(m,n) from the data line $D_n$ by controlling the ON/OFF status of switches M21 and M22. The third pixel P3(m,n) is controlled by the third switching device, which includes only one switch M3. The third switching device is for selectively transmitting the data signal to the third pixel P3(m,n) from the data line $D_n$ by controlling the ON/OFF status of switch M3. It should be noted that all the switches can be thin film transistors. In addition, the relative location of the first pixel P1 (m,n), second pixel P2(m,n), and third pixel P3(m,n) does not have to be the same as shown in FIG. 6. The requirement for the relative location of these pixels, according to the present invention, is that the first pixel P1(m,n), the second pixel P2(m,n), and the third pixel P3(m,n) are three adjacent pixels in the same row and are coupled to the same scan line $S_m$ and data line $D_n$.

According to the preferred embodiment of the present invention, as shown in FIG. 6, the switching device of the first pixel P1 (m,n) includes two switches M11 and M12. The gate electrode of switch M11 is coupled to the scan line $S_{m+2}$, and the drain electrode of switch M11 is coupled to the equivalent capacitor C1 of the first pixel P1 (m,n). The drain electrode of switch M12 is serially coupled to the source electrode of switch M11; the gate electrode of switch M12 is coupled to scan line $S_m$; and the source electrode of switch M12 is coupled to data line $D_n$. The switching device of the second pixel P2(m,n) includes two switches M21 and M22. The gate electrode of switch M21 is coupled to scan line $S_{m+1}$, and the drain electrode of switch M21 is coupled to the equivalent capacitor C2 of the second pixel P2(m,n). The drain electrode of switch M22 is serially coupled to the source electrode of switch M21; the gate electrode of switch M22 is coupled to scan line $S_m$; and the source electrode of switch M22 is coupled to data line $D_n$. The switching device of the third pixel P3(m,n) includes only one switch M3. The gate electrode of switch M3 is coupled to scan line $S_m$; the drain electrode of switch M3 is coupled to the equivalent capacitor C3 of the third pixel P3(m,n); and the source electrode of switch M3 is coupled to the data line $D_n$. In this manner, the switching device of the first pixel P1 (m,n) is controlled by two scan lines $S_m$ and $S_{m+2}$; the switching device of the second pixel P2(m,n) is controlled by two scan lines $S_m$ and $S_{m+1}$; and the switching device of the third pixel P3(m,n) is controlled by the scan line $S_m$ only. All pixels in the same row can be divided into three groups according to the coupling scan line(s). Taking the $m^{th}$ pixel row as an example, all pixels of the first pixel group are controlled by the scan lines $S_m$ and $S_{m+2}$, just as is the first pixel P1 (m,n). All pixels of the second pixel group are controlled by scan lines $S_m$ and $S_{m+1}$, as is the second pixel P2(m,n). All pixels of the third pixel group are controlled by scan lines $S_m$ only, such as the third pixel P3(m,n).

Figure 7:
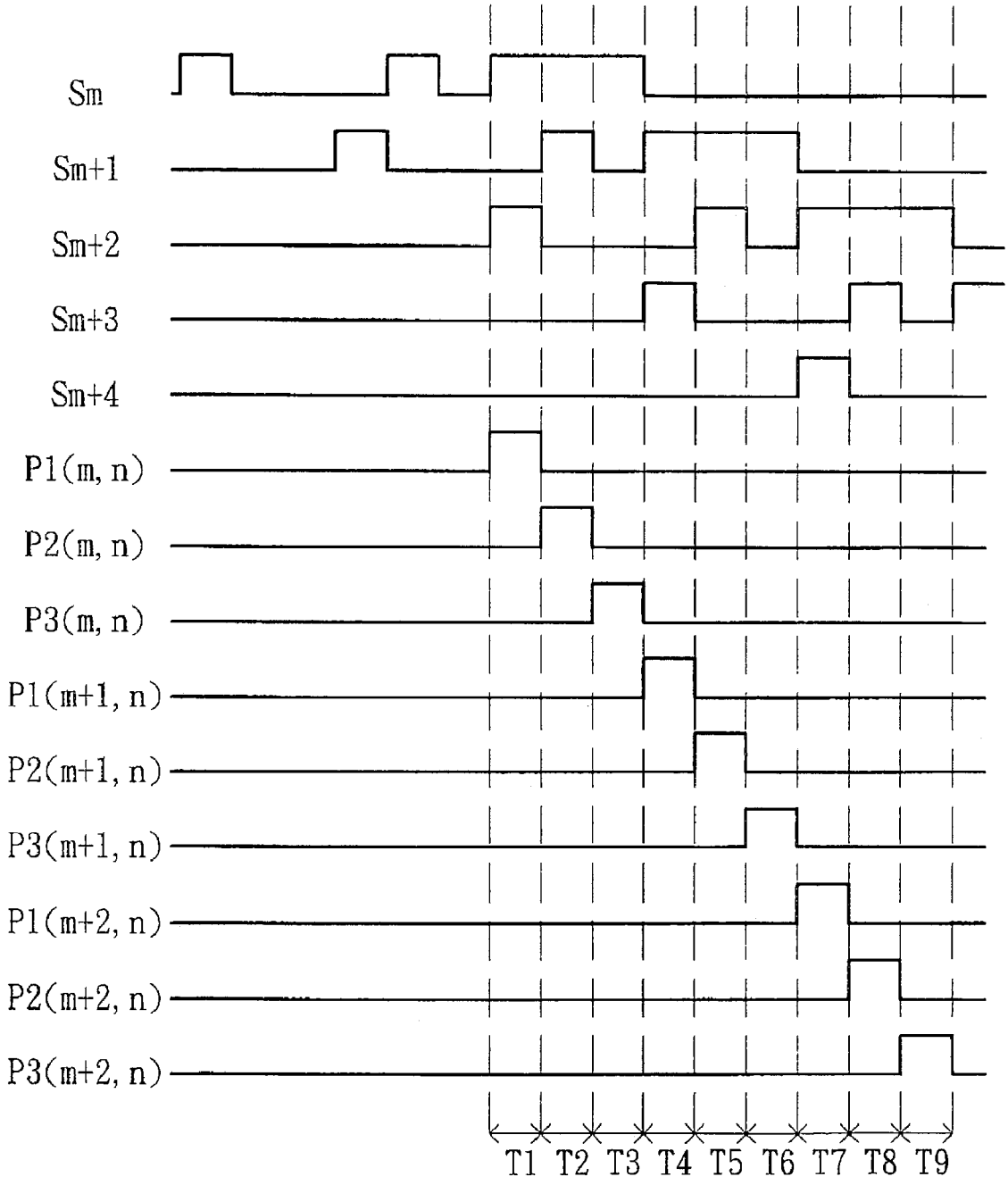
FIG. 7 shows a timing chart of the scan signals of scan lines $S_m$, $S_{m+1}$, $S_{m+2}$, $S_{m+3}$, and $S_{m+4}$ and the ON and OFF status of corresponding pixels P1(m,n), P2(m,n), P3(m,n), P1(m+1,n), P2(m+1,n), P3(m+1,n), P1(m+2,n), P2(m+2,n), and P3(m+2,n), shown in FIG. 6.

FIG. 7 shows a timing chart of the scan signals of scan lines $S_m$, $S_{m+1}$, $S_{m+2}$, $S_{m+3}$, and $S_{m+4}$ and the ON and OFF status of corresponding pixels P1(m,n), P2(m,n), P3(m,n), P1(m+1,n), P2(m+1,n), P3(m+1,n), P1 (m+2,n), P2(m+2,n), and P3(m+2,n), shown in FIG. 6. The driving method executed by the above-described driving circuit is used for driving each pixel row in turn. The driving method includes three scanning procedures. The first scanning procedure is used for turning ON all pixels of the first pixel group in the same row and then applying the corresponding data signals to these pixels respectively. The second scanning procedure is used for turning ON all pixels of the second pixel group in the same row and then inputting the corresponding data signals into the pixels respectively. The third scanning procedure is used for turning ON all pixels of the third pixel group in the same row and then inputting the corresponding data signals into the pixels respectively.

Using pixels P1(m,n), P2(m,n), and P3(m,n) in the $m^{th}$ row as an example we see that in time period T1, the first scanning procedure is executed so that scan lines $S_m$ and $S_{m+2}$ are enabled. Scan line $S_{m+2}$ is coupled to the gate electrode of switch M11, and scan line $S_m$ is coupled to the gate electrode of switch M12. In this manner, switches M11 and M12 can be turned ON in the time period T1, and the data signal for the first pixel P1 (m,n) can be transmitted to the first pixel P1 (m,n) from data line $D_n$ through switches M12 and M11. In addition, all other data signals can be transmitted to the corresponding pixels in the $m^{th\ row}$, which are controlled by scan lines $S_m$ and $S_{m+2}$. It should be noted that during the time period T1, switch M22 of the second switching device can be turned ON since scan line $S_m$ is enabled. However, since switch M21 of the second switching device is OFF because scan line $S_{m+1}$ is disabled, the data signal to be input to the first pixel P1 (m,n) cannot be input to the second pixel P2(m,n) in the time period T1. After the data signals are input to the pixel P1 (m,n), as well as all others pixels in the $m^{th}$ row, which belong to the first pixel group, the scan line $S_{m+2}$ is disabled. The switch M11 can be turned OFF after scan line $S_{m+2}$ is disabled, and in this manner, the first scanning procedure is completed.

In time period T2, the second scanning procedure is executed so that scan lines $S_m$ and $S_{m+1}$ are enabled. The scan line $S_{m+1}$ is coupled to the gate electrode of switch M21, and scan line $S_m$ is coupled to the gate electrode of switch M22. In this manner, the switches M21 and M22 can be turned ON in time period T2, and the data signal for the second pixel P2(m,n) can be transmitted to the second pixel P2(m,n) from data line $D_n$ through switches M22 and M21. In addition, all other data signals can be transmitted to the corresponding pixels in the $m^{th}$ row, which are controlled by scan lines $S_m$ and $S_{m+1}$ as well. It should be noted that during time period T2, switch M12 of the first switching device can be turned ON since scan line $S_m$ is enabled. However, switch M11 of the second switching device is OFF because the scan line $S_{m+2}$ is disabled, the data signal for inputting to the second pixel P2(m,n) cannot be input to the first pixel P1 (m,n) in the time period T2. After the data signals are input into pixel P2(m,n), as well as all others pixels in the $m^{th}$ row, which belong to the second pixel group, scan line $S_{m+1}$ is disabled. The switch M21 can be turned OFF after the scan line $S_{m+1}$ is disabled. In this manner, the second scanning procedure is accomplished.

In time period T3, the third scanning procedure is executed so that scan line $S_m$ is enabled. The scan line $S_m$ is coupled to the gate electrode of the switch M3. In this manner, the switches M3 can be turned ON in time period T3, and the data signal for the third pixel P3(m,n) can be transmitted to the third pixel P3(m,n) from the data line $D_n$ through the switch M3. In addition, all other data signals can be transmitted to the corresponding pixels in the $m^{th}$ row, which is controlled only by scan line $S_m$ as well. It should be noted that during the time periods T1 and T2, the switch M3 of the third switching device can be turned ON since scan line $S_m$ is enabled. Therefore, the data signals for inputting into the first pixel P1 (m,n) and the second pixel P2(m,n) can be input into the third pixel P3(m,n) respectively. However, when the third scanning procedure is executed during time period T3, the exact data signal specific to the third pixel P3(m,n) can be input into the third pixel P3(m,n). In addition, the switch M12 of the first switching device and the switch M22 of the second switching device can be turned ON since scan line $S_m$ is enabled. However, since the switch M1 of the first switching device is OFF, scan line $S_{m+2}$ is disabled, switch M21 of the second switching device is OFF, scan line $S_{m+1}$ is disabled, and the data signal for input to the third pixel P3(m,n) cannot be input to the first pixel P1 (m,n) or the second pixel P2(m,n). In this manner, after executing the first, second, and third scanning procedures, all the exact data signals of the pixels in the $m^{th}$ row have been input.

Each pixel row is driven in turn by executing the driving method described above. Therefore, the driving circuit can control the luminance of each pixel in the display panel.

Figure 8A:
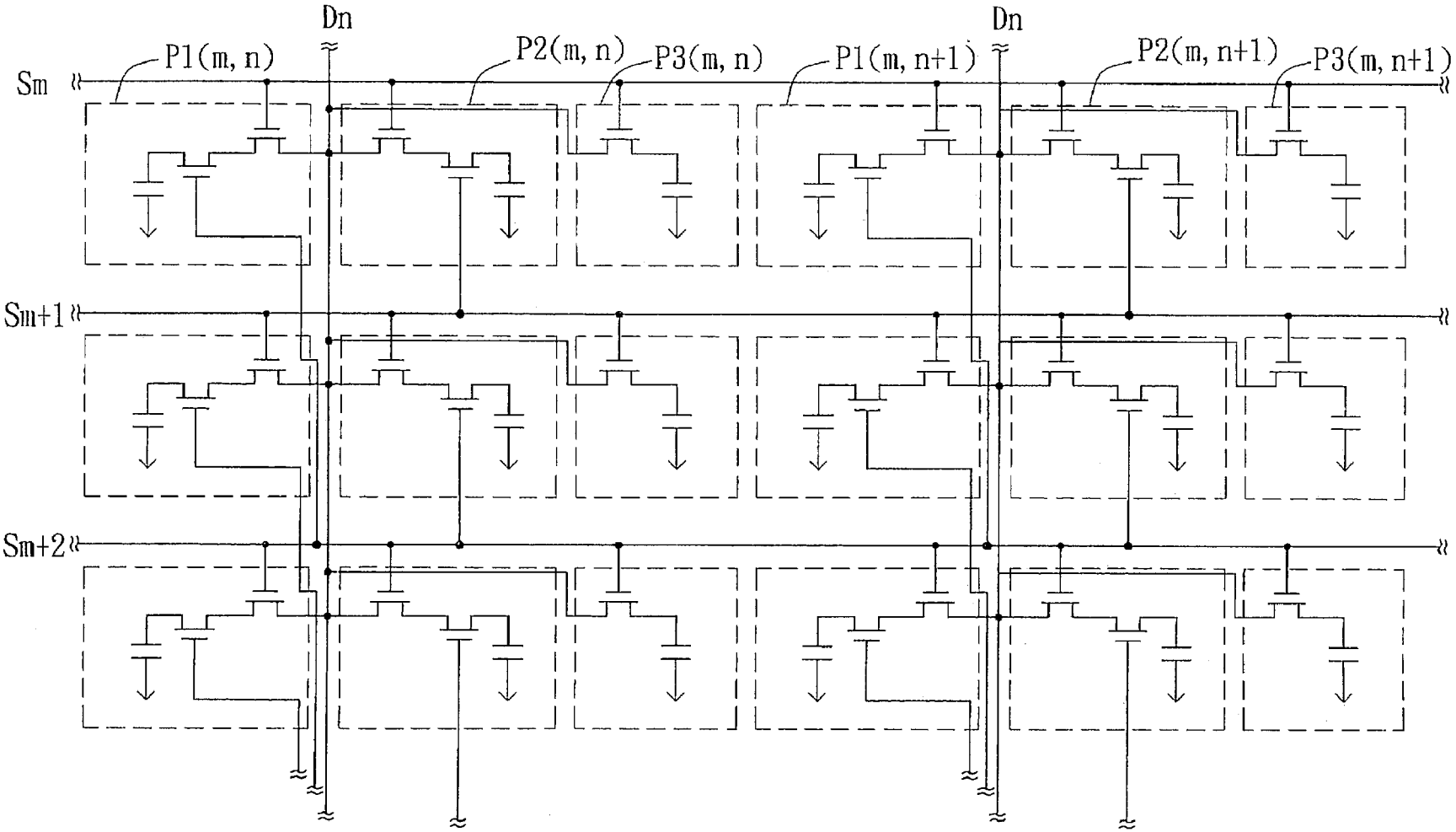
FIGS. 8A~8C illustrate the driving circuit according to the preferred embodiment of the present invention shown in FIG. 6 of the pixels, the pixel columns, and the pixel units respectively.
Figure 8B:
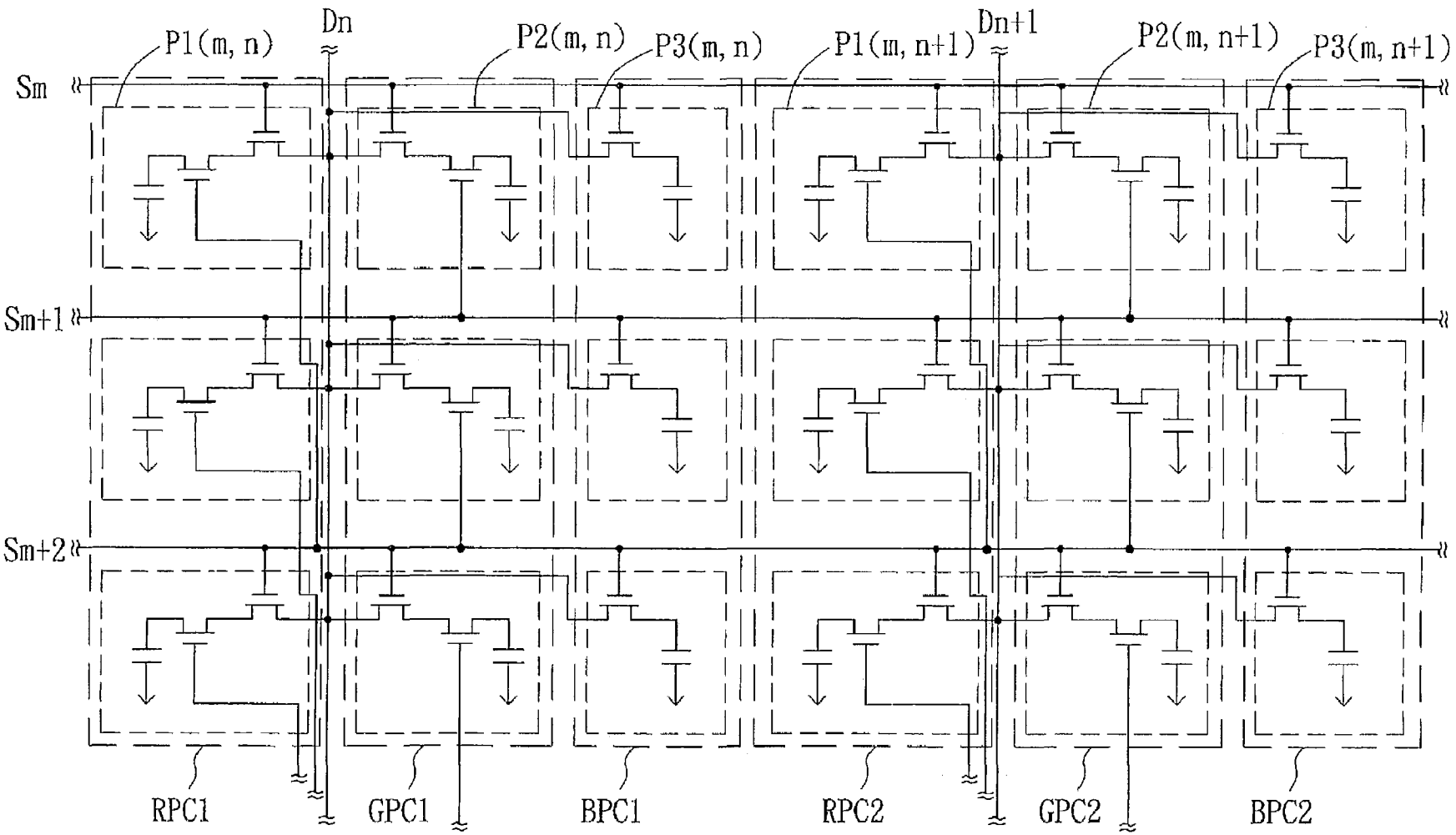
Figure 8C:
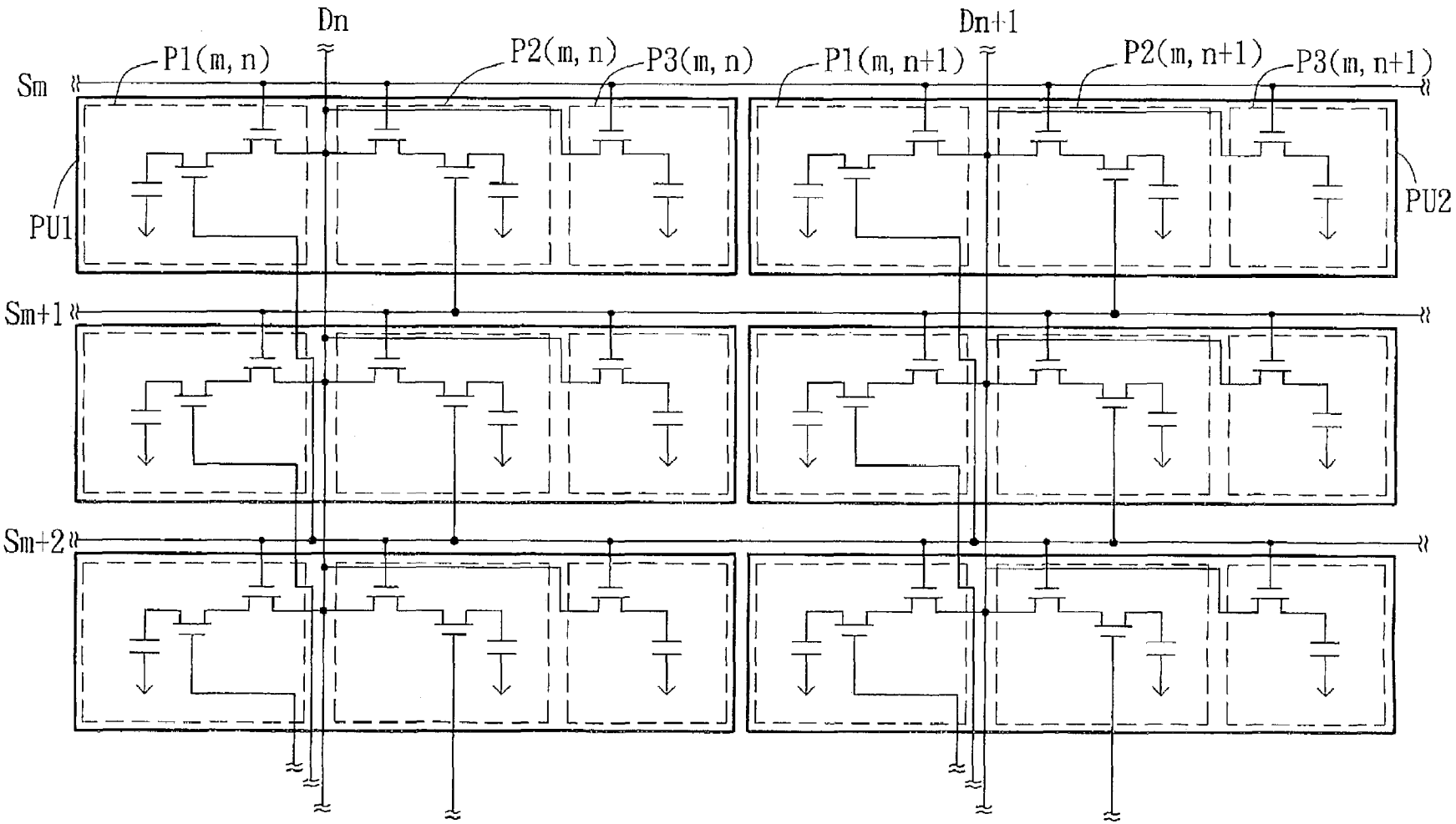

FIGS. 8A~8C illustrate the conventional driving circuit from FIG. 6 showing the pixels, the pixel columns, and the pixel units respectively. FIG. 8A shows the driving circuit of the present invention in which every three adjacent pixels are coupled to the same data line, as shown in FIG. 6. Referring to FIG. 8B, and taking the adjacent pixels P1 (m,n), P2(m,n), and P3(m,n) as an example, the method used for inputting data signals into the corresponding pixels of the color display panel is to input the data signal for showing red into pixel P1(m,n), the data signal for green into pixel P2(m,n), and the data signal for blue into pixel P3(m,n). All other pixels in the same column with pixel P1 (m,n) are input with data signals for showing red; the pixel column is thus called the red pixel column RPC1. In the same manner, all other pixels in the same column with pixel P2(m,n) are input with the data signals for showing green; the pixel column is thus called the green pixel column GPC1 and all other pixels in the same column with pixel P3(m,n) are input with the data signals for showing blue; the pixel column is thus called the blue pixel column BPC1. Following the same order, the pixel column which includes pixel P1 (m,n+1) is for displaying red; the pixel column which includes pixel P2(m,n+1) is for displaying green; and the pixel column which includes pixel P3(m,n+1) is for displaying blue. Therefore, these three adjacent pixel columns are called red pixel column RPC2, green pixel column GPC2, and blue pixel column BPC2 respectively. In FIG. 8C, pixel unit PU1 includes three adjacent pixels: P1 (m,n), P2(m,n), and P3(m,n). Since pixels P1(m,n) P2(m,n), and P3(m,n) are for displaying red, green, and blue respectively, the display color of pixel unit PU1 can be controlled by controlling the luminance of these three pixels. In the same manner, the display color of pixel unit PU2 can be controlled by controlling the luminance of pixels P1 (m,n+1), P2(m,n+1), and P3(m,n+1) respectively. Every three adjacent pixels are grouped into a pixel unit for displaying color, as shown in FIG. 8C.

Taking pixel P1 (m,n) of pixel unit PU1 and pixel P1 (m,n+1) of pixel unit PU2 in FIG. 8C as an example, both pixels P1 (m,n) and P1 (m,n+1) are for displaying red. However, since the switching device of pixel P1(m,n) and pixel P1 (m,n+1) are identical, the degree of feed-through effect and the aperture ratio of these two pixels are substantially the same. Therefore, the luminance of these two pixels P1 (m,n) and P1 (m,n+1) can be substantially the same when the magnitude of the data signals input to these two pixels P1 (m,n) and P1(m,n+1) respectively, are identical. In the same manner, the luminance of the pixel of pixel unit PU1, which is for displaying green, and the corresponding pixel of pixel unit PU2 and the pixel of pixel unit PU1, which is for displaying blue, and the corresponding pixel of pixel unit PU2 may be the same when the respective data signals input are of the same magnitude. Therefore, the odd-even problem can be improved when the data signals input into all pixels in the display panel have the same magnitude, thus improving display performance.

The display apparatus with the driving circuit in accordance with the invention has the following advantages. First, a reduced number of data lines are required. Therefore, the pitch between adjacent data lines can be increased. It is easier to connect all data lines to the corresponding outer leads of the tape carrier packages. Also, since the number of data lines is decreased, the aperture ratio of the display panel is increased. Second, the switching devices of corresponding pixels of all pixel units are identical, the degree of feed-through effect and the aperture ratio of these corresponding pixels are substantially the same and the odd-even line problem can be improved. If the pixels are set in the mirror image form, the odd-even problem can be further improved.

While the invention has been described by way of example and in terms of the preferred embodiment, it is to be understood that the invention is not limited to the disclosed embodiment. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A display apparatus with a driving circuit in which every three adjacent pixels are coupled to the same data line, comprising:

a first scan line, a second scan line, and a third scan line arranged in a first direction;

a first data line arranged in a second direction, wherein the second direction is perpendicular to the first direction;

a first pixel, a second pixel, and a third pixel coupled to the first data line and the corresponding scan lines respectively;

a first switching device in the first pixel for selectively transmitting a first data signal into the first pixel from the first data line, wherein the first switching device is controlled by the first scan line and the third scan line;

a second switching device in the second pixel for selectively transmitting a second data signal into the second pixel from the first data line, wherein the second switching device is controlled by the first scan line and the second scan line; and a third switching device in the third pixel for selectively transmitting a third data signal into the third pixel from the first data line, wherein the third switching device is controlled by the first scan line.

2. The display apparatus according to claim 1, wherein the second scan line is adjacent to the first scan line and the third scan line respectively.

3. The display apparatus according to claim 1, wherein the first switching device, the second switching device, and the third switching device comprise a plurality of thin film transistors (TFT) and each thin film transistor includes a first source/drain electrode, a second source/drain electrode, and a gate electrode.

4. The display apparatus according to claim 3, wherein the first switching device further comprises two switches, which are a first switch and a second switch.

5. The display apparatus according to claim 4, wherein the first switch is serially coupled to the second switch.

6. The display apparatus according to claim 5, wherein the first source/drain electrode of the first switch is coupled to the first data line; the gate electrode of the first switch is coupled to the first scan line; the gate electrode of the second switch is coupled to the third scan line; and the second switch is for transmitting the first data signal to the first pixel from the first switch.

7. The display apparatus according to claim 3, wherein the second switching device further comprises two switches, which are a third switch and a fourth switch.

8. The display apparatus according to claim 7, wherein the third switch is serially coupled to the fourth switch.

9. The display apparatus according to claim 8, wherein the first source/drain electrode of the third switch is coupled to the first data line; the gate electrode of the third switch is coupled to the first scan line; the gate electrode of the fourth switch is coupled to the second scan line; and the fourth switch is for transmitting the second data signal to the second pixel.

10. The display apparatus according to claim 3, wherein the third switching device further comprises one switch, which is a fifth switch.

11. The display apparatus according to claim 10, wherein the first source/drain electrode of the fifth switch is coupled to the first data line, and the gate electrode of the fifth switch is coupled to the first scan line.

12. The display apparatus according to claim 3, wherein the method for driving the driving circuit of the display apparatus comprising:

enabling the first scan line and the third scan line;

inputting the first data signal into the first pixel through the first data line;

disabling the third scan line;

enabling the second scan line;

inputting the second data signal into the second pixel through the first data line;

disabling the second scan line;

inputting the third data signal into the first data signal through the first data line; and disabling the first scan line.

13. The display apparatus according to claim 1, wherein the display apparatus is a liquid crystal display (LCD).

* * * * *